US005852907A

United States Patent [19]

Tobin et al.

[11] Patent Number: 5,852,907

[45] Date of Patent: Dec. 29, 1998

[54] TIE FOR FOAM FORMS

[75] Inventors: Michael W. Tobin, Shorwood; Joseph G. Pasma, White Bear Lake, both of Minn.

[73] Assignee: AFM Corporation, Excelsior, Minn.

[21] Appl. No.: 247,306

[22] Filed: May 23, 1994

[51] Int. Cl.[6] ..... E04B 2/30

[52] U.S. Cl. ..... 52/714; 52/426; 52/431; 52/562; 52/715; 249/40; 249/38; 249/191; 249/216

[58] Field of Search ..... 52/426, 427, 431, 52/562, 714, 715; 249/40, 213, 216, 38, 190, 191, 193, 217, 218, 219.1

[56] References Cited

U.S. PATENT DOCUMENTS

| | | | |
|---|---|---|---|
| Re. 16,793 | 11/1927 | Smith | 249/216 |
| 611,514 | 9/1898 | Schratwieser | 52/715 X |
| 668,366 | 2/1901 | Wight | 52/713 X |
| 917,028 | 4/1909 | Ellery | 52/562 |
| 1,437,323 | 11/1922 | McClure | 249/38 X |
| 1,564,888 | 12/1925 | Orlopp et al. | 249/218 |
| 1,575,931 | 3/1926 | Orlopp | 52/715 |
| 1,997,638 | 4/1935 | Hayden | 249/213 |
| 2,099,260 | 11/1937 | Colt | 249/213 |
| 3,750,997 | 8/1973 | Anderson et al. | 249/219.1 X |
| 4,223,501 | 9/1980 | DeLozier | 52/426 X |
| 4,706,429 | 11/1987 | Young | 52/426 X |
| 4,765,109 | 8/1988 | Boeshart | 52/426 |
| 4,791,767 | 12/1988 | Boeshart | 52/426 |
| 4,884,382 | 12/1989 | Horobin | 52/426 |
| 4,889,310 | 12/1989 | Boeshart | 52/426 X |
| 4,916,879 | 4/1990 | Boeshart | 52/426 |
| 4,936,540 | 6/1990 | Boeshart | 52/426 X |
| 4,938,449 | 7/1990 | Boeshart | 249/216 |
| 5,039,058 | 8/1991 | Boeshart | 249/194 |
| 5,065,561 | 11/1991 | Mason | 52/426 X |
| 5,107,648 | 4/1992 | Roby | 52/309.12 |
| 5,209,039 | 5/1993 | Boeshart | 249/216 X |

FOREIGN PATENT DOCUMENTS

| | | | |
|---|---|---|---|
| 322344 | 1/1956 | Germany | 52/426 |
| 2830028 | 1/1980 | Germany | 249/40 |
| 176146 | 5/1961 | Sweden | 52/562 |
| 327617 | 3/1958 | Switzerland | 52/713 |

OTHER PUBLICATIONS

Computer Search Printouts.

*Primary Examiner*—Carl D. Friedman
*Assistant Examiner*—Laura A. Callo
*Attorney, Agent, or Firm*—Wm. Bruce Day

[57] ABSTRACT

A form tie for interlocking parallel and spaced foam panels. The tie is formed of an elongate planar strap having a lattice arrangement of openings for flow of concrete. Each of the opposite ends of the strap have an end plate and an inside plate spaced to bracket a corner of a foam form panel with each of the plates extending in a perpendicular or "Y" axis direction to the longitudinal or "X" axis of the strap. Each of the end portions forming the bracket also has vane shelves extending between the end and inside plates in a "Z" axis direction to the strap for support of the foam form panel corner. "U" shaped holders in the edges of the strap and overcenter tabs in the openings provide retainers to hold reinforcement bars, commonly termed rebar. The strap is preferably formed of a heavy gauge polypropylene.

1 Claim, 4 Drawing Sheets

TIE FOR FOAM FORMS

FIELD OF THE INVENTION

This invention relates to ties for poured concrete walls and particularly to such form ties which are adapted for use with foam panel forms.

BACKGROUND OF THE INVENTION

Form ties have been used at least for the last 100 years, but most forms have either been of plywood, steel or aluminum which are stripped from the poured concrete wall after the concrete has sufficiently set. The tie ends project from the wall and are typically fractured or severed to remove projecting sharp ends which can be unsightly and injure persons walking too close to the wall. In recent years, there has been the development of EPS, or expanded polystyrene panels, as forms for poured concrete walls. Form ties are used for these methods as well; however, after the concrete has hardened, the foam form panels are left in place on the walls to serve as permanent exterior and interior insulation. Preferably, the foam is protected from insect infestation by highly effective insecticide treatments disclosed in Savoy U.S. Pat. No. 5,270,108 for Building Material With Protection From Insects, Molds and Fungi.

The foam form system utilizes a system of foam panels with each panel connected in parallel, spaced apart alignment by a series of rigid plastic ties between the panels. The panels are locked together in stacks by the disclosed form ties to form parallel, spaced apart forms. The forms may be either six inches apart, eight inches apart or other wall thickness as selected. Concrete is then poured between the panels, the hardened concrete adhering to the foam panels and to the ties which hold the form panels together and in a spaced relation.

OBJECTS OF THE INVENTION

The objects of the present invention are: to provide an improved form tie with interlocking parallel and spaced foam panels which is sufficiently sturdy to hold the foam panels in place and avoid breakout of the forms caused by hydraulic pressure of the poured concrete; to provide such a form tie which is specifically adapted for the use of foam form panels; to provide such a form tie which is easy to use with foam panels; and to provide such a form tie which is economical to manufacture and specifically designed for the intended purpose.

Other objects and advantages of the present invention will become apparent to those skilled in the art when read in connection with the following detailed description of the preferred embodiment.

SUMMARY OF THE INVENTION

The form tie of the present invention is specifically adapted for interlocking parallel and spaced apart foam form panels and comprises an elongate, generally planar strap having a lattice arrangement of openings for flow of concrete. The strap extends in a longitudinal axis direction and has opposite end portions. Each of the end portions has parallel plates, including an end plate and an inside plate, which are spaced to provide a bracket for a foam form panel. Each of the end and inside plates extends in a perpendicular "Y" axis direction to the longitudinal "X" axis of the strap. Each of the end portion brackets has vane shelves extending between the end and inside plates in a "Z" axis direction to the strap for support of a foam form panel.

DESCRIPTION OF THE PREFERRED EMBODIMENT

Figure 1:
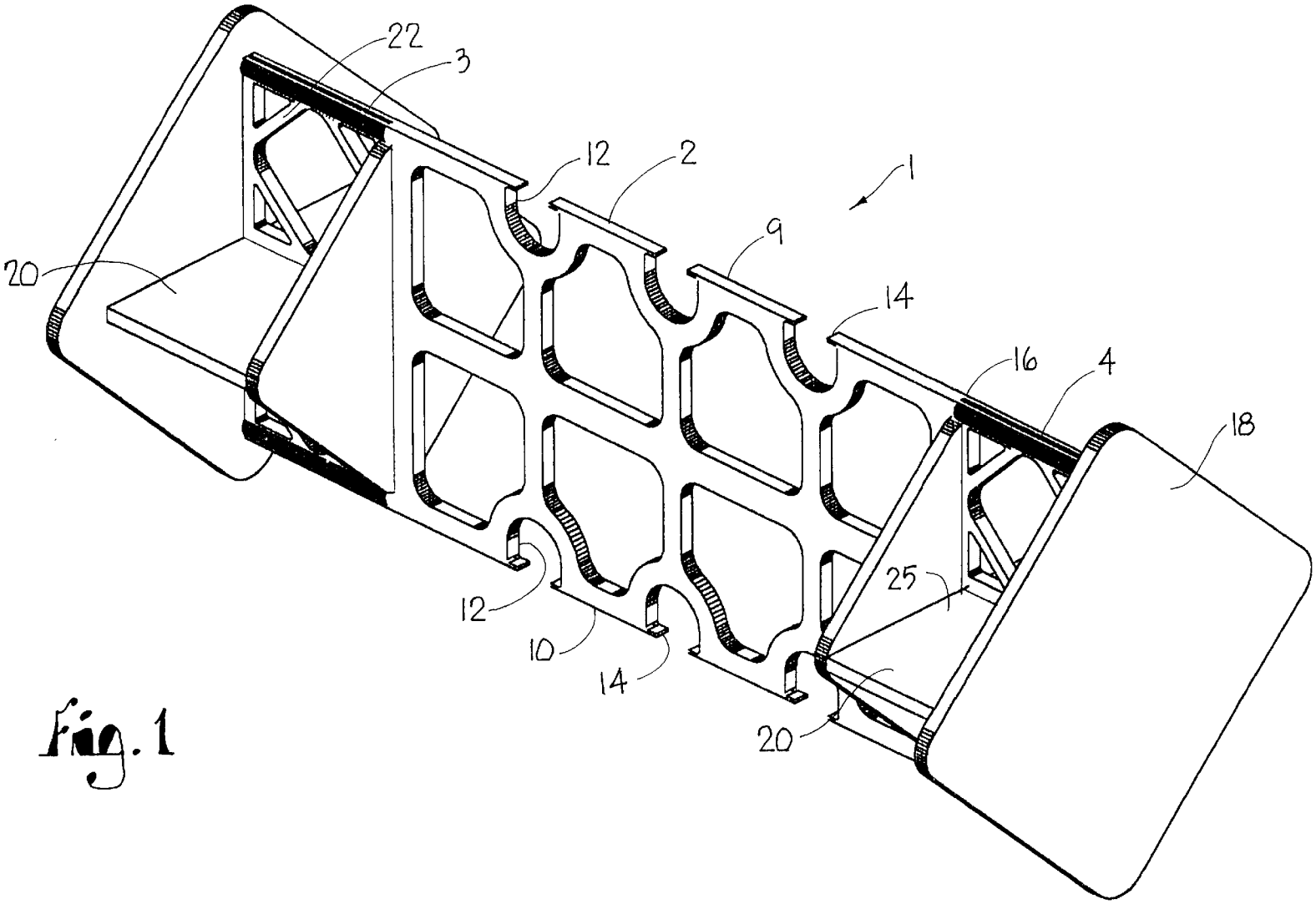
FIG. 1 is a perspective view of the tie of the present invention.
Figure 2:
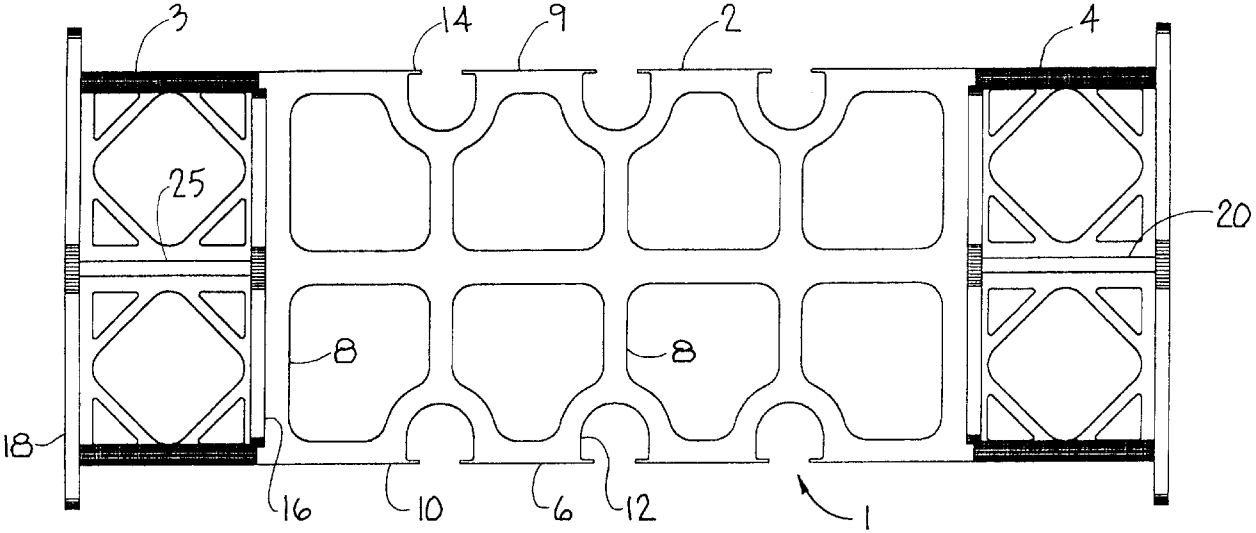
FIG. 2 is an elevational view of the form tie.
Figure 3:
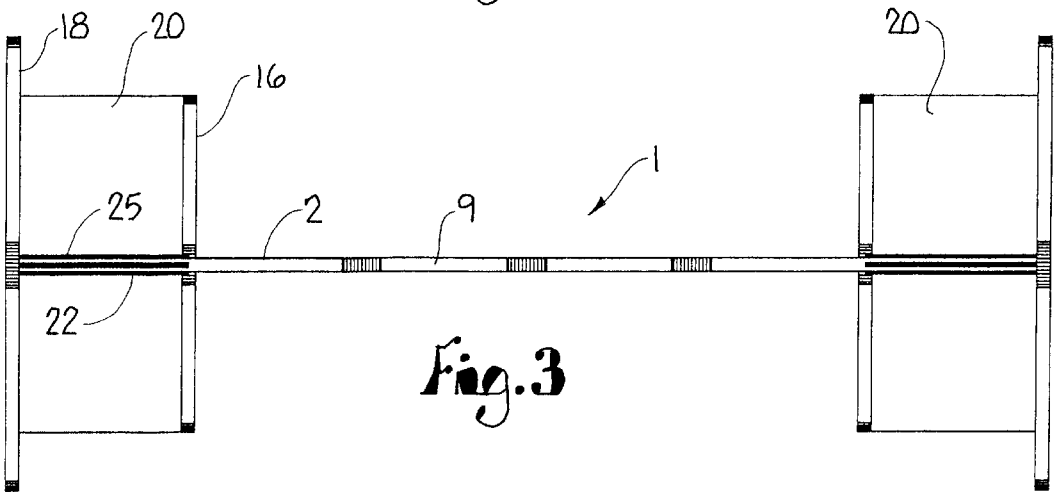
FIG. 3 is a plan view of the form tie.

Referring to the drawings in more detail, the reference 1, FIG. 1, designates a form tie embodying the present invention. The form tie 1 generally comprises an elongate, planar strap 2 having opposite end portions 3 and 4. The strap 2 has a center section 6 between the end portions 3 and 4. The form tie 1 is elongate and planar in general relation with the end portions 3 and 4 having plates extending perpendicularly to form brackets for holding foam form panels.

The center section 6 is preferably arranged in a lattice configuration including multiple openings 8 for flow of concrete. The center section 6 includes spaced upper and lower edges 9 and 10, each with generally U-shaped recesses 12 therein for insertion of reinforcing bar, commonly called rebar. Each of the recesses 12 include over center tabs 14 to snap over the rebar and hold it in the recesses.

Each of the end portions 3 and 4 includes the perpendicular plate members as previously mentioned which form brackets to hold foam panels. Each end portion includes an inside planar wall member 16 extending perpendicular to the "X" axis or longitudinal direction of the strap 2 and in a "Y" axis direction. The wall member 16 is preferably rectangular and arranged in a diamond position with respect to the strap 2. The diamond position is so that the corners of the wall member 16 are positioned at the upper and lower edges 9 and 10 and other corners extend outwardly.

Each of the end portions 3 and 4 further include an end planar wall member 18 which forms an end cap to the strap 2 and is of a rectangular configuration, arranged in a diamond position and which is larger than the wall member 16. That is, it has a distance between its corners which is longer than the distance between the upper and lower edges 9 and 10 of the strap 2. The wall member 18 extends parallel to the wall member 16 and is spaced from the wall member 16 a sufficient distance, such as two inches, to position a corner of a foam panel.

Extending perpendicular to the wall members 16 and 18 and in a "Z" axis direction relative to the "X" axis of the strap 2 is a shelf vane 20. The shelf vane 20 extends from both sides of the strap 2, and together with a strap portion 22, the strap 2 extends between the wall members 16 and 18 forms a bracket 25 to hold the foam wall panels.

The preferred material of the form tie 1 is polypropylene rated to 0° F. However, other forms of polypropylene, such as butyl polypropylene, may be rated to even lower temperatures such as −20° F. In other installations, nylon or polyethylene may be appropriate.

Figure 4:
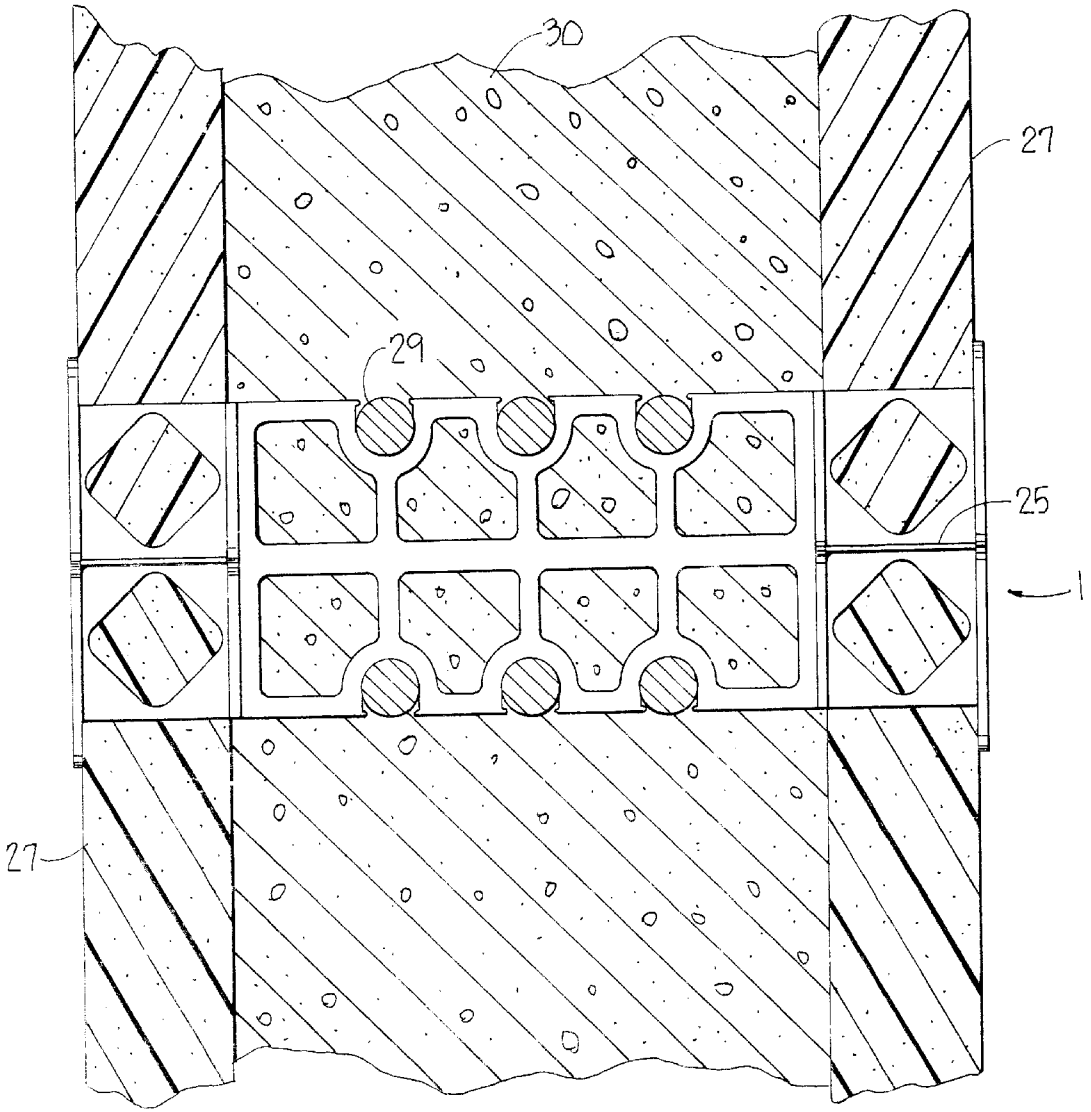
FIG. 4 is a cross-sectional view of a section of poured concrete wall with the form tie in place.

The form tie 1 is shown emplaced within a poured concrete wall in FIG. 4. As illustrated, the form tie 1 is situated so that foam panels 27 may have their corners mounted in the bracket portions 25 of the form tie 1. Another mounting method is to slit the foam panel so that either the shelf vane 20 or the strap portion 22 extends into the slit.

Reinforcing bars, or rebar, 29 is positioned in the recesses 12 of the form tie 1 for reinforcement of the concrete. Thereafter, concrete 30 is poured into the form as defined by the foam panels 27 held together by the form tie 1 and flows through the openings 8 in the form tie 1. In the example shown in FIG. 4, the rebar 29 is shown in the recesses 12 in both upper and lower edges 9 and 10. This is done for purposes of illustration and is more appropriate for vertical installation.

Figure 5:
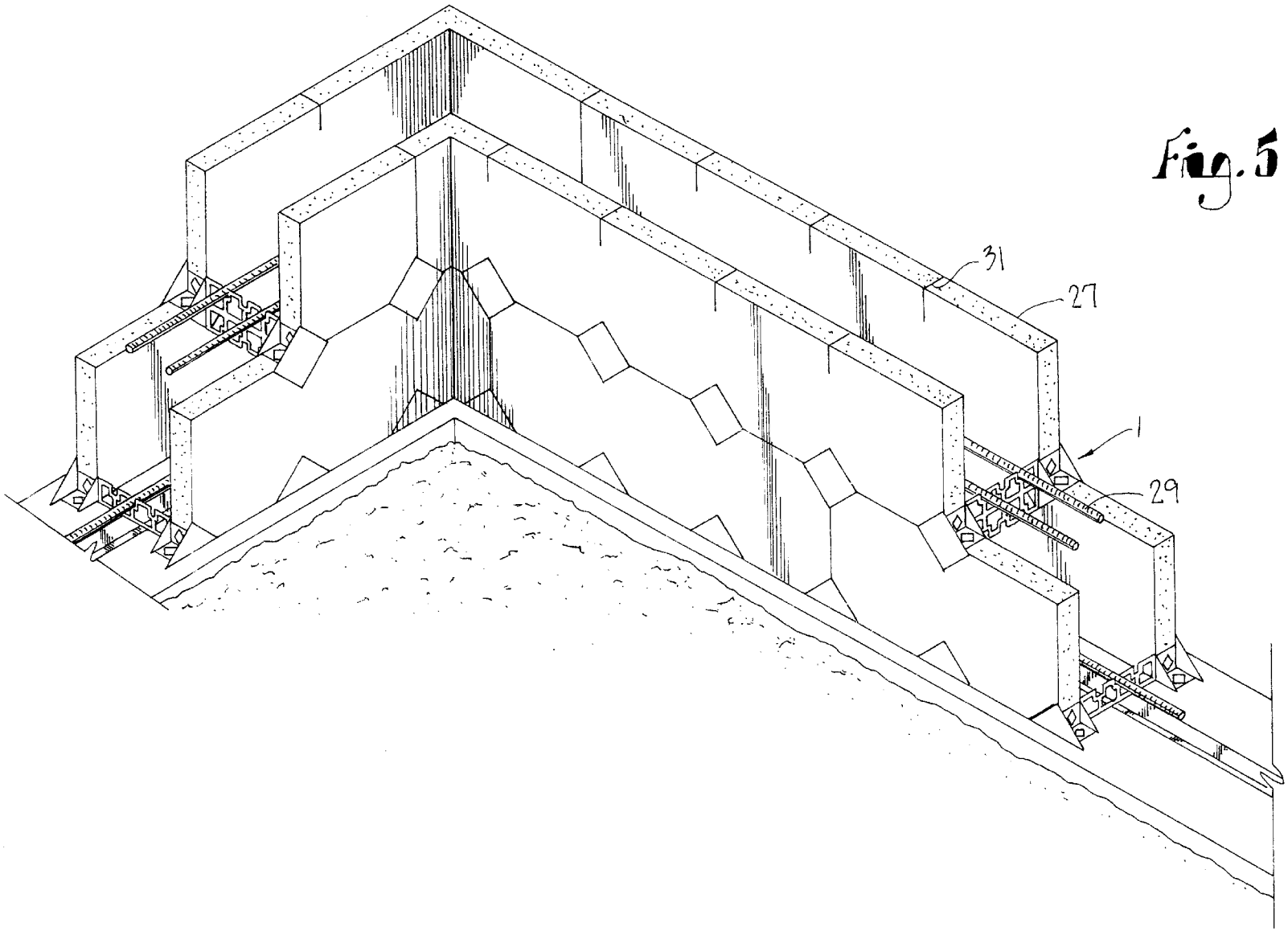
FIG. 5 is a perspective view of a wall section of a foam form installation and showing the wall ties in place.

In the example shown in FIG. 5, foam panels 27 are stacked atop each other and connected using the form ties 1 and with rebar 29 laid into the recesses 12 in the strap 2. For best results, particularly considering that the EPS foam panels 27 are not as strong as plywood or aluminum forms commonly used for foundation pouring, the ties 1 are preferably installed on 12" centers. Such an installation is shown in FIG. 5. Slits 31 cut into the foam panel 27 at intervals of 12" allow installation of the bracket portion 25 of the form tie onto the foam panels 27.

It is to be understood that this invention may be embodied in various dimensions for poured wall thicknesses of 6", 8" or even 10", and greater or lesser dimensions of the bracket 25 portion of the tie 1 may be utilized as desired.

For example, the bracket 25 can be dimensioned so as to accept 2" thick foam panels 27 or, particularly for extreme cold climates, can be dimensioned to accommodate 4" thick foam panels.

Although a preferred embodiment of this invention has been illustrated and described, it is not to be limited thereto except insofar as set forth in the following claims.

What is claimed and desired to be secured by Letters Patent is as follows:

1. A plastic form tie for interlocking parallel, spaced apart foam form panels to create a wall form for pouring concrete, the tie comprising:

a) an elongate, generally planar strap having a plurality of lattice work openings for flow of concrete therethrough, said strap extending in a longitudinal X axis direction and having top and bottom edges each with notches for receiving rebar, said strap having opposite end portions;

b) each of said end portions having parallel plates including an end plate and an inside plate spaced to bracket a foam form panel, with each of said plates extending in a perpendicular Y axis direction to said strap to form a Tee end;

c) each of said end portions having structural tension members in the form of vane shelves extending between said end and inside plates in a Z axis direction to said strap for structural engagement of said inside and end plates and for support of a foam form panel; and d) each of said end plates being of a larger size than said inside plates, being of a diamond shape and integrally connected to said vane shelves to resist outward forces on said inside and end plates and said wall form.

* * * * *